United States Patent [19]

Fagg

[11] Patent Number: 5,005,593

[45] Date of Patent: Apr. 9, 1991

[54] PROCESS FOR PROVIDING TOBACCO EXTRACTS

[75] Inventor: Barry S. Fagg, Winston-Salem, N.C.

[73] Assignee: R. J. Reynolds Tobacco Company, Winston-Salem, N.C.

[21] Appl. No.: 262,770

[22] Filed: Oct. 26, 1988

Related U.S. Application Data

[63] Continuation-in-part of Ser. No. 149,044, Jan. 27, 1988, abandoned.

[51] Int. Cl.[5] ..... A24B 15/24; A24B 15/26

[52] U.S. Cl. ..... 131/297; 131/298; 131/352; 131/356; 131/310

[58] Field of Search ..... 131/310, 297, 298, 352, 131/356

[56] References Cited

U.S. PATENT DOCUMENTS

| | | | |
|---|---|---|---|
| 283,622 | 8/1983 | Liebreich et al. . | |
| 802,487 | 10/1905 | Wimmer . | |
| 1,577,768 | 3/1926 | White . | |
| 1,949,012 | 2/1934 | Frank . | |
| 2,128,043 | 8/1938 | Garner . | |
| 2,995,476 | 8/1961 | Hind et al. . | |
| 3,046,997 | 7/1962 | Hind . | |
| 3,136,321 | 6/1964 | Davis . | |
| 3,139,435 | 6/1964 | Staley et al. | 260/291 |
| 3,316,919 | 5/1967 | Green et al. . | |
| 3,369,552 | 2/1968 | Carroll . | |
| 3,390,685 | 7/1968 | Von Bethmann et al. . | |
| 3,396,735 | 8/1968 | Von Bethmann et al. | 131/143 |
| 3,398,754 | 8/1968 | Tughan . | |
| 3,424,171 | 1/1969 | Rooker . | |
| 3,561,451 | 2/1971 | Jacin . | |
| 3,803,004 | 4/1974 | Egri . | |
| 3,880,172 | 4/1975 | Anderson et al. . | |
| 4,068,671 | 1/1978 | Casey . | |
| 4,150,677 | 4/1979 | Osborne, Jr. et al. . | |
| 4,153,063 | 5/1979 | Roselius et al. . | |
| 4,200,113 | 4/1980 | Schmidt . | |
| 4,351,346 | 9/1982 | Brummer et al. . | |
| 4,421,126 | 12/1983 | Gellatly . | |
| 4,506,682 | 3/1985 | Muller . | |
| 4,605,016 | 8/1986 | Soga et al. . | |
| 4,628,947 | 12/1986 | Driscoll et al. . | |
| 4,727,889 | 3/1988 | Niven, Jr. et al. . | |

FOREIGN PATENT DOCUMENTS

| | | |
|---|---|---|
| 72/3935 | 7/1972 | South Africa . |

OTHER PUBLICATIONS

*Tobacco Science*, III, pp. 83–85 (1959), Hankin.

*Tabacco Science*, XXVI, pp. 25–29 (1982), Snook et al.

*Primary Examiner*—Vincent Millin

[57] ABSTRACT

Concentrated tobacco extracts are provided by first extracting water soluble components from tobacco. The aqueous extract then is spray dried to a dry powder form. As such, the extract is in a low solvent form (i.e., the solvent content including moisture content of the extract is less than about 12 weight percent). The spray dried extract is contacted with a lower alcohol such as methanol or ethanol, and certain components are extracted from the spray dried extract. The resulting extracted components are isolated from the alcohol solvent in order to yield a tobacco essence. The essence has a homogeneous, viscous character and exhibits a tobacco aroma. The essence is useful as a flavoring agent for cigarettes and other smoking articles.

123 Claims, 1 Drawing Sheet

PROCESS FOR PROVIDING TOBACCO EXTRACTS

CROSS REFERENCE TO RELATED APPLICATION

This is a continuation-in-part of application Ser. No. 149,044 filed Jan. 27, 1988.

BACKGROUND OF THE INVENTION

The present invention relates to tobacco extracts, and in particular to processes for providing selected flavorful components from tobacco in a concentrated form.

Popular smoking articles such as cigarettes have a substantially cylindrical rod shaped structure and include a charge of smokable material such as shreds or strands of tobacco (i.e., cut filler) surrounded by a wrapper such as paper thereby forming a tobacco rod. It has become desirable to manufacture cigarettes having cylindrical filters aligned in an end-to-end relationship with the tobacco rod. Typically, filters are manufactured from fibrous materials such as cellulose acetate and are attached to the tobacco rod using a circumscribing tipping material.

An important step in the cigarette manufacturing process involves the casing and top dressing of the smokable material. For example, a wide variety of flavorants (which may include concentrated tobacco extracts) are applied to the smokable materials in order to increase the smoke quality and other such characteristics of the cigarette. As a result, interest in concentrated extracts of particular components of tobacco has increased. For example, various processes for producing and using tobacco extracts, aroma oils and concentrates are proposed in U.S. Pat. Nos. 3,136,321 to Davis; 3,316,919 to Green; 3,424,171 to Rooker; 4,421,126 to Gellatly and 4,506,682 to Mueller. Such materials conveniently can be applied to tobacco laminae, reconstituted tobacco sheet and other engineered tobacco materials, cigarette filters and other substrates, and the like.

It would be highly desirable to provide an improved process for efficiently and effectively producing tobacco extracts, and in particular to a process for producing a concentrated tobacco extract.

SUMMARY OF THE INVENTION

The present invention relates to a process for providing a tobacco extract, and preferably a tobacco extract in a concentrated form. The process involves extracting components from tobacco material using a first solvent. The first solvent and the tobacco components extracted thereby then are subjected to a solvent removal process. Preferably, the resulting extracted components are provided in a low solvent form (e.g., in a solid form). The solid extract then is subjected to extraction conditions using a second solvent different from the first solvent. The components so extracted from the solid extract by the second solvent then can be isolated to provide a concentrated extract. In addition, the insoluble residue which remains after the extraction using the second solvent can be collected.

More particularly, the process of the present invention involves extracting components from tobacco material using a solvent having an aqueous character. The resulting extracted components then are subjected to a solvent removal (e.g., drying) process, preferably to the point that the extracted components are provided in a low solvent (e.g., a low moisture) form. Typically, the extracted components are provided in a low solvent form by using a spray drying process, although other such solvent removal processes such a freeze drying process can be employed. A second solvent different from the first solvent is employed to extract components from the previously obtained extracted components. Typically, a spray dried tobacco extract in low solvent form is contacted with the second solvent, and certain components are extracted from the spray dried extract. The second solvent and components extracted thereby then can be separated from the insoluble residue which remains. The components extracted by the second solvent then can be isolated from that second solvent. Typically, the extracted components are isolated in concentrated form by evaporating as much of the second solvent as possible, thereby yielding an isolated tobacco essence. However, the tobacco components extracted by the second solvent can be applied to a substrate (e.g., tobacco cut filler) along with the second solvent or a significant portion of the second solvent. Alternatively, the insoluble residue which remains after the extraction using the second solvent can be collected and employed as a flavoring agent in smoking article manufacture.

As used herein, the term "essence" is meant to refer to a concentrated tobacco extract having a viscous, homogeneous character.

The process of the present invention allows the skilled artisan to obtain concentrated tobacco extracts in an efficient and effective manner. In particular, highly aromatic and flavorful tobacco extracts conveniently can be isolated from many of the resins, waxes and other lipoid materials of tobacco.

The extracts of this invention are useful as flavoring agents for cigarettes and other smoking articles. For example, the extracts of this invention can be used as casing or top dressing components for smokable filler for cigarette manufacture. The extracts also can be applied to tobacco leaf, processed tobacco stems, reconstituted tobacco leaf or non-tobacco substrates. Alternatively, the extracts can be applied to cigarette filters or positioned elsewhere within the cigarette to provide tobacco flavor when the cigarette is used.

DETAILED DESCRIPTION OF THE PREFERRED EMBODIMENTS

Figure 1:
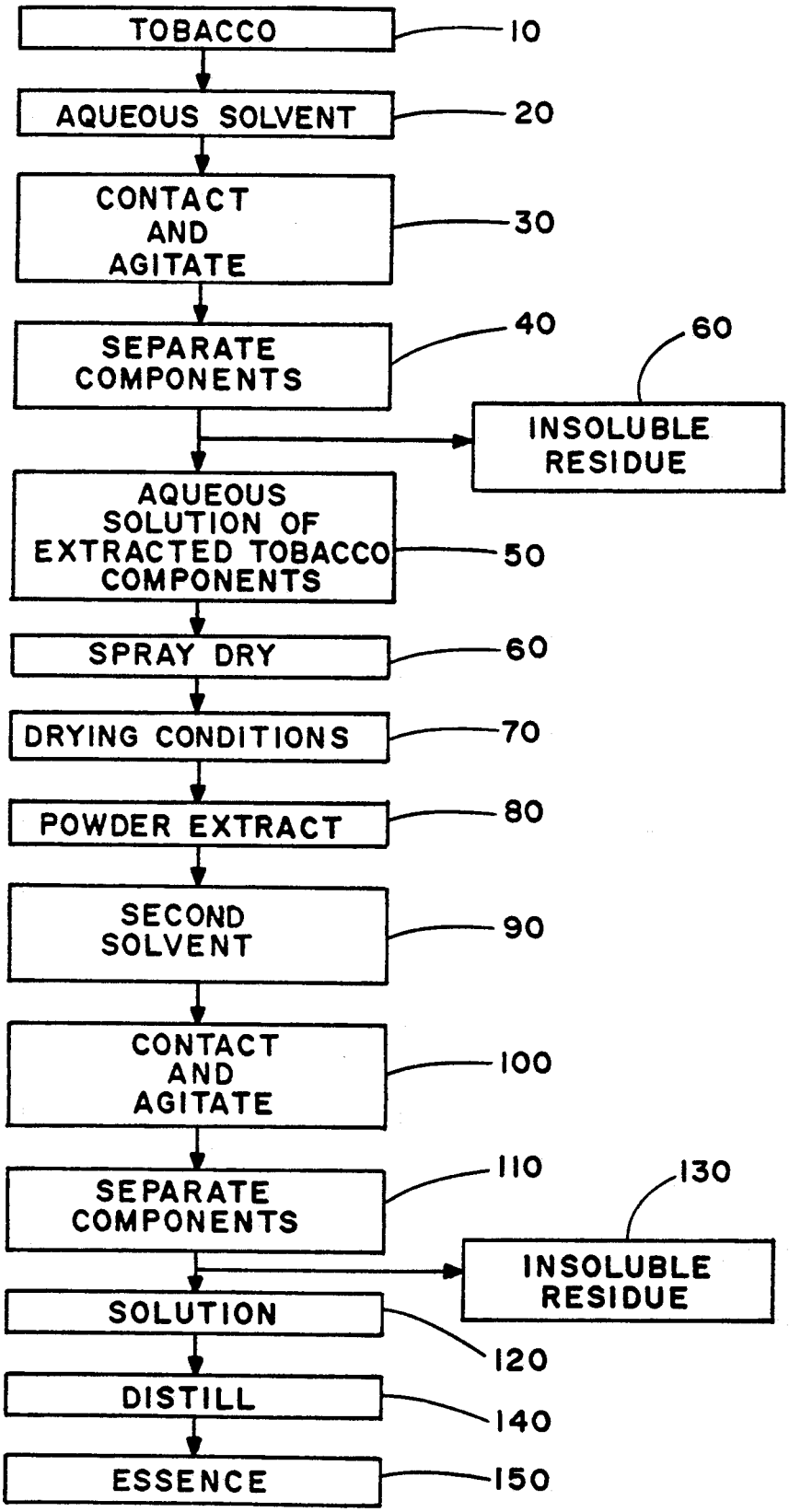
FIG. 1 is a schematic diagram of the process steps representative of one embodiment of this invention.

Referring to FIG. 1, tobacco material 10 is contacted with an aqueous solvent 20. The resulting mixture is stirred or otherwise agitated using a suitable agitation means 30. As a result, water soluble components are extracted from the tobacco by the solvent. The mixture is subjected to separation conditions 40 so as to provide a solution 50 of water soluble tobacco components and a water insoluble residue 60. The solution 50 then is concentrated to an appropriate solids level and then is subjected to spray drying conditions 70 so as to yield the extracted components in a low moisture form. For example, an extract having the form of a low moisture powder is provided.

The powder 80 is contacted with a second solvent 90 such as methanol. The resulting mixture is agitated using a suitable agitation means 100. As a result, certain components are extracted from the previously provided spray dried extract. The mixture is subjected to separation conditions 110 so as to provide a solution 120 of soluble tobacco components and an insoluble residue 130. The solution 120 is subjected to distillation conditions 140 so as to isolate the extracted components. In particular, the methanol is obtained as distillate, and a concentrated extract 150 is collected. For example, a concentrated extract 150 having the form of an essence is provided.

The tobacco material can vary. Examples of suitable tobaccos include flue-cured, Burley, Maryland, and Oriental tobaccos, as well as the rare or specialty tobaccos. The tobacco material generally has been aged, and can be in the form of laminae and/or stem, or can be in a processed form. Tobacco waste materials and processing by-products such as fines, dust, scrap, stems and stalks can be employed. Unaged, uncured mature, or immature tobaccos also can be employed. The aforementioned materials can be processed separately, or as blends thereof.

The tobacco material can have a variety of sizes for extraction. For example, the tobacco can be in strip form or cut filler form. Tobacco materials in strip or cut filler form are desirable in that the spent materials which remain after the extraction step can be dried and further employed in the manufacture of smokable materials. Alternatively, the tobacco can be ground to a powder of fine size. Small particle size tobacco materials are desirable in order to provide for increased extraction efficiency as well as decrease the time period over which extraction may occur.

The tobacco material is contacted with a first solvent having an aqueous character. Such a solvent consists primarily of water, and can be essentially pure water in certain circumstances. However, the solvent can include water having substances such as pH buffers, pH adjusters, organic or inorganic salts, surfactants, carbonates, bicarbonates, or the like dissolved or otherwise incorporated therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the first solvent can vary. Typically, the weight of solvent relative to the tobacco material is greater than 6:1, oftentimes greater than 8:1 and in certain instances greater than 12:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and first solvent is not particularly critical.

The conditions under which the first extraction is performed can vary. Typical temperatures range from about 5° C. to about 60° C., with about 15° C. to about 30° C. being preferred, and ambient temperature being especially preferred. The solvent/tobacco material mixture can be agitated (e.g., stirred, shaken or otherwise mixed) in order to increase the rate at which extraction occurs. Typically, adequate extraction of components occurs in less than about 60 minutes, oftentimes less than about 30 minutes. A wide variety of materials or components can be extracted from the tobacco materials. The particular materials and the amounts of the particular materials which are extracted often depend upon the type of tobacco which is processed, the properties of the particular solvent, and the extraction conditions (e.g., which include the temperature at which the extraction occurs as well as the time period over which an extraction is carried out). For example, a solvent consisting essentially of pure water will most often extract primarily the water soluble components of the tobacco material, while a co-solvent mixture of water and a minor amount of an alcohol can be used to extract the water soluble components of the tobacco material as well as certain amounts of components having other solubility characteristics.

The solvent and extracted components are separated from the insoluble residue. The manner of separation can vary; however, it is convenient to employ conventional separation means such as filtration, centrifugation, or the like. It is desirable to provide a solution of solvent and extracted components having a very low level of suspended solids.

The first solvent and tobacco components extracted thereby are subjected to a solvent removal process such that the extracted tobacco material achieves a predominantly solid character or form. For example, solvent is removed from the extracted tobacco components at least in an amount sufficient to provide extracted components having a paste-like character. By the term "paste" is meant a material having discernible solid particles, even though the material as a whole may have some free flowing character (i.e., be fairly thick and exhibit some viscosity). Typically, predominantly solid tobacco extracts can be provided when the solvent level is reduced to below about 25 weight percent. However, predominantly solid tobacco extracts preferably are provided so as to have a solvent level of below about 20 weight percent, more preferably below about 15 weight percent. Predominantly solid tobacco extracts can have characteristics which range from that of a very dry, free-flowing powder to that of a paste. When the solvent removal processes are such that an agglomerated dry solid is provided, it is desirable to treat the solid to a grinding operation or the like to provide a finely divided solid material.

The extracted components most preferably are provided in a low solvent form. By the term "low solvent form" is meant that the solvent content including the moisture content of a tobacco material is less than about 12 percent, based on the total weight of the tobacco material. For example, when the first solvent is essentially pure water, the moisture content of the tobacco material in low solvent form is less than about 12 weight percent. Generally, it is desirable to provide tobacco materials having a solvent content less than 10 weight percent; while tobacco materials having solvent contents in the range of about 2 weight percent to about 8 weight percent are particularly preferred. Extracted components in low solvent form have a generally solid form and often can resemble a dry powder, especially when the extract is spray dried.

Convenient methods for providing the extracted components in low solvent form include spray drying, freeze drying, belt drying, flash drying, or other such methods. It is particularly desirable to concentrate the liquid extract prior to spray drying or freeze drying the extract. Spray drying of the liquid extract is especially preferred. For purposes of this invention, spray drying is a one-step continuous process for removing a liquid from a solution and producing a dried particulate form of the extracted components within the solution by spraying a feed of the solution into a hot drying medium. A representative spray drying process is described in U.S. Pat. No. 3,398,754 to Tughan. For purposes of this invention, freeze drying is an indirect, batch or continuous process for removing the liquid from a solution and producing a dried form of the extracted components by freezing the solution and drying the solution in a frozen state through sublimation under high vacuum. A representative freeze drying process is described in U.S. Pat. No. 3,316,919 to Green. Methods and conditions for providing extracted materials in a low solvent or solid form (e.g., as a powder) will be apparent to the skilled artisan. Extracted tobacco materials having a high surface area granular or powder forms are particularly desirable, as subsequent extraction steps using the second solvent are normally quite efficient when a high surface area solid is subjected to extraction steps using the second liquid solvent.

The extracted components which have been subjected to the solvent removal process and which preferably are in low solvent form (e.g., in solid form) are contacted with a second solvent. The second solvent is different from the first solvent. The second solvent is a solvent which does not have the ability to extract all of the components which are extracted by the first solvent while extracting some portion of the extracted components which are in a low solvent form. For example, for a spray dried tobacco tobacco material having a moisture content of about 5 weight percent which has been obtained from a first extraction using water as the first solvent, up to about 60 weight percent of the spray dried material conveniently can be extracted by a suitable second solvent.

Suitable second solvents include organic liquids, halocarbons such as the commercially available freons, and the like. Of particular interest are organic liquids such as the lower alcohols including methanol and ethanol. Isopropanol and lower ethers such as diethyl ether can be employed as second solvents for certain types of tobaccos. Co-solvent mixtures can be employed as second solvents. Suitable co-solvent mixtures include methanol/ethanol, methanol/isopropanol, ethanol/isopropanol, and the like.

The amount of extracted tobacco material which is contacted with the second solvent can vary. Typically, the weight of the solvent relative to the solid form extracted tobacco material is greater than 3:1, oftentimes greater than 5:1, and in certain instances greater than 10:1. The amount of second solvent relative to the tobacco material depends upon factors such as type of solvent, the temperature at which the second extraction is performed, the type of tobacco which is being processed, the manner in which contact of the tobacco material and solvent is conducted, and other such factors. The manner of contacting the tobacco material and second solvent is not particularly critical.

The conditions under which the second extraction is performed can vary. Typical temperatures range from about 5° C. to about 60° C., with about 15° C. to about 30° C. being preferred, and ambient temperature being especially preferred. The solvent/tobacco mixture can be agitated in order to increase the rate at which extraction occurs. Typically, adequate extraction of components occurs in less than about 60 minutes, oftentimes less than 30 minutes.

The materials or components which are extracted by the second solvent can vary. The particular materials which are extracted often depend upon the properties of the particular solvent as well as the extraction conditions. Depending upon the tobacco type, composition of the low solvent form extract, solvent type and extraction conditions, it is possible to ultimately obtain flavorful tobacco essences having high contents of nicotine, sugars, and other flavorants. However, depending upon the solvent type and extraction conditions, the tobacco essences can have high contents of certain flavorants but relatively low nicotine contents.

The second solvent and extracted components are separated from the insoluble residue. The manner of separation can vary; however, it is convenient to employ conventional separation means such as filtration, centrifugation, or the like. It is desirable to provide a solution of solvent and extracted components having a very low level of suspended solids. The residue can be collected, isolated and employed for use in the manufacture of smokable materials, if desired.

The extracted components can be isolated from the second solvent. As used herein, the term "isolate" in referring to the isolation of extracted components from the second solvent is meant that the extracted components are separated from the second solvent to yield the extracted components in a concentrated form. In particular, extracted components in concentrated form are isolated by removing a majority or essentially all of the second solvent from the second solvent/extracted component solution. As such, highly preferred isolation operations involve removing as much of the second solvent as possible thereby yielding a concentrated extract essentially free of that solvent. Oftentimes, it is desirable to separate the second solvent from the tobacco components extracted thereby as soon as possible after the extraction step using the second solvent is complete.

The method of isolation can vary, and the conditions for the isolation are dependent upon the solvent. During an isolation operation, it is most desirable to employ as low a temperature as possible to remove the majority of the solvent from the extracted components while minimizing loss of tobacco volatiles from the extract. For example, the liquid solvent can be evaporated (e.g., distilled) from the extracted components. However, it is desirable to control the time/temperature profile of materials subjected to heat during the solvent evaporation process so that the extracted tobacco components are not subjected to a particularly high temperature for a lengthly period of time. The use of thin film evaporation techniques is one particularly suitable method for separating the second solvent from the tobacco components extracted thereby. Vacuum distillation techniques also can be employed. Preferably, vacuum distillation techniques in a pressure range of about 22 to about 28 inch Hg, and a temperature of less than about 60° C. can effectively remove a lower alcohol solvent from the extract mixture to provide a concentrated extract essentially free of lower alcohol solvent. As such, highly concentrated extracts of tobacco materials essentially free of the second solvent are obtained without the loss of significant amounts of tobacco volatiles including nicotine, sugars and other flavors.

The process of the present invention provides a unique method for producing tobacco extracts using a two-stage extraction process while minimizing or eliminating interaction between the first and second solvents. Thus, extraction of tobacco material using two solvents independently can be performed using two solvents which are miscible with one another (e.g., water and a lower alcohol). As the first and second solvents are different from one another, a certain amount of the initial extract is left as a residue after the second extraction is complete. Thus, depending upon the extraction solvents and the extraction conditions, the composition of the ultimate concentrated extract can be selectively altered.

The concentrated extracts are useful as flavoring agents for cigarettes and other smoking articles. For example, the concentrated extracts can be employed as casing or top dressing components during the preparation of smokable cut filler for the manufacture of cigarettes. As another example, when tobacco material in strip or cut filler form is processed according to this invention, the concentrated extracts can be applied to the spent materials from the first stage extraction, particularly after the spent materials have been dried to a moisture level of less than about 15 weight percent. Manners and methods for drying spent materials from extraction processes will be apparent to the skilled artisan. For example, the spent materials (e.g. pulp) which remain after the tobacco is extracted using the first solvent can be processed into a sheet-like form, and the concentrated extracts can be reapplied (i.e., as such or in a diluted form) to the spent materials. The resulting smokable material then can be employed in cigarette manufacture.

Alternatively, the concentrated extracts can be employed as flavoring agents in those smoking articles described in U.S. Pat. Nos. 4,708,151 to Shelar; 4,714,082 to Banerjee et al and 4,756,318 to Clearman et al.

The following examples are provided in order to further illustrate various embodiments of the invention but should not be construed as limiting the scope thereof. Unless otherwise noted, all parts and percentages are by weight.

EXAMPLE 1

An aged flue-cured tobacco in cut filler form and having a nicotine content of about 2 percent is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of volatiles (including nicotine and other flavoring agents) is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried material is a brown, powdery material, and has a moisture content of about 5 percent to about 6 percent, and a nicotine content of about 4.2 percent.

Into a flask is charged 10 g of the spray dried material and about 80 g of methanol. The flask is sealed and placed in an ultrasonic bath (temperature about 20° C.). The mixture is subjected to ultrasonic treatment (i.e., agitation) for about 15 minutes.

The agitated mixture is filtered through No. 1 qualitative filter paper using a Buchner funnel and a vacuum flask. The flask which contained the spray dried material and methanol, and the spent spray dried filter cake is washed with about 5 ml to about 10 ml of methanol. The filtrate is collected from the vacuum flask and transferred to a 125 ml round bottom flask. The filtrate is subjected to vacuum treatment (at about 22 inch Hg vacuum and in a water bath held at about 60° C.) using a Brinkman Rotovap laboratory rotary evaporator in order to remove essentially all of the methanol and isolate a residue.

The residue or essence is a homogeneous, viscous liquid having a dark brown color, and displays a tobacco aroma. The essence has a weight of about 5.2 g and has a nicotine content of about 7.1 percent.

EXAMPLE 2

Spray dried material as described in Example 1 is contacted with ethanol. In particular, into a flask is charged 10 g of the spray dried material and about 80 g of absolute ethanol. The flask is sealed and placed in an ultrasonic bath (temperature about 20° C.). The mixture is subjected to ultrasonic treatment for about 15 minutes.

The agitated mixture is filtered through No. 1 qualitative filter paper using a Buchner funnel and a vacuum flask. The flask which contained the spray dried material and ethanol, and the spent spray dried filter cake is washed with about 5 ml to about 10 ml of ethanol. The filtrate is collected from the vacuum flask, transferred to a 125 ml round bottom flask, and subjected to vacuum treatment as described in Example 1 in order to remove essentially all of the ethanol and isolate the residue.

The residue is a homogeneous, viscous liquid having a dark brown color and displays a tobacco aroma. The essence has a weight of about 1.1 g and a nicotine content of about 14.3 percent.

EXAMPLE 3

Aged Oriental tobacco in cut filler form and having a nicotine content of about 1.3 percent is processed to a spray dried form generally in the manner described in Example 1. The spray dried material is a brown, powdery material, and has a moisture content of about 7 percent and a nicotine content of about 2.6 percent.

Into a flask is charged 10 g of the spray dried Oriental tobacco material and about 80 g of methanol. The flask is sealed and placed in an ultrasonic bath (temperature about 20° C.). The mixture is subjected to ultrasonic treatment for about 15 minutes.

The agitated mixture is filtered through No. 1 qualitative filter paper using a Buchner funnel and a vacuum flask. The flask which contained the spray dried material and methanol, and the spent spray dried filter cake is washed with about 5 ml to about 10 ml of methanol. The filtrate is collected from the vacuum flask, transferred to a 125 ml round bottom flask, and subjected to vacuum treatment as described in Example 1 in order to remove essentially all of the methanol and isolate the residue.

The residue is a homogeneous, viscous liquid having a dark brown color and displays a tobacco aroma. The essence has a weight of about 5.6 g and a nicotine content of 2.6 percent.

EXAMPLE 4

Spray dried material as described in Example 3 is contacted with absolute ethanol. In particular, into a flask is charged 10 g of the spray dried material and about 80 g of ethanol. The flask is sealed and placed in an ultrasonic bath (temperature about 20° C.). The mixture is subjected to ultrasonic treatment for about 5 minutes.

The agitated mixture is filtered through No. 1 qualitative filter paper using a Buchner funnel and a vacuum flask. The flask which contained the spray dried material and ethanol, and the spent spray dried filter cake is washed with about 5 ml to about 10 ml of ethanol. The filtrate is collected from the vacuum flask, transferred to a 125 ml round bottom flask, and subjected to vacuum treatment as described in Example 1 in order to remove essentially all of the ethanol and isolate the residue.

The residue is a homogeneous, viscous liquid having a dark brown color and displays a tobacco aroma. The essence has a weight of about 0.7 g and a nicotine content of about 6.1 percent.

EXAMPLE 5

Aged Burley tobacco in cut filler form and having a nicotine content of about 3.3 percent is processed to a spray dried form generally in the manner described in Example 1. The spray dried material is a brown powdery material, and has a moisture content of about 5 percent and a nicotine content of about 6.6 percent.

Into a flask is charged 10 g of the spray dried Burley tobacco material and methanol. The flask is sealed and placed in an ultrasonic bath (temperature about 20° C.). The mixture is subjected to ultrasonic treatment for about 15 minutes.

The agitated mixture is filtered through No. 1 qualitative filter paper using a Buchner funnel and a vacuum flask. The flask which contained the spray dried material and methanol, and the spent spray dried filter cake is washed with about 5 ml to about 10 ml of methanol. The filtrate is collected from the vacuum flask, transferred to a round bottom flask, and subjected to vacuum treatment as described in Example 1 in order to remove essentially all of the methanol and isolate the residue.

The procedure is performed independently four times using 30 ml, 60 ml, 100 ml and 140 ml of methanol, for each respective procedure.

The residue or essence for each of the four samples is a viscous liquid having a dark brown color and dislays a tobacco aroma. Each of the four essences contains greater than 90 percent of the amount of nicotine orginally present in the spray dried material. The weight of each essence is 2.5 g, 3.3 g, 3.5 g and 3.6 g for the spray dried materials extracted with methanol in the amount of 30 ml, 60 ml, 100 ml and 140 ml, respectively.

EXAMPLE 6

Spray dried material as described in Example 5 is contacted with absolute ethanol. In particular, into a flask is charged 10 g of the spray dried material and about 80 g of ethanol. The flask is sealed and placed in an ultrasonic bath (temperature about 20° C.). The mixture is subjected to ultrasonic treatment for about 15 minutes.

The agitated mixture is filtered through No. 1 qualitative filter paper using a Buchner funnel and a vacuum flask. The flask which contained spray dried material and ethanol, and the spent spray dried filter cake is washed with about 5 ml to about 10 ml of ethanol. The filtrate is collected from the vacuum flask, transferred to a 125 ml round bottom flask, and subjected to vacuum treatment as described in Example 1 in order to remove essentially all of the ethanol and isolate the residue.

The residue is a homogeneous, viscous liquid having a dark brown color and displays a tobacco aroma. The essence has a weight of about 1.7 g and a nicotine content of about 28.5 percent.

EXAMPLE 7

Spray dried material as described in Example 5 is contacted with isopropanol. In particular, into a flask is charged 10 g of the spray dried material and about 80 g of isopropanol. The flask is sealed and placed in an ultrasonic bath (temperature about 20° C.). The mixture is subjected to ultrasonic treatment for about 15 minutes.

The agitated mixture is filtered through No. 1 qualitative filter paper using a Buchner funnel and a vacuum flask. The flask which contained the spray dried material and isopropanol, and the spent spray dried filter cake is washed with about 5 ml to about 10 ml of isopropanol. The filtrate is collected from the vacuum flask, transferred to a 125 ml round bottom flask, and subjected to vacuum treatment as described in Example 1 in order to remove essentially all of the isopropanol and isolate the residue.

The residue is a homogeneous, viscous liquid having a dark brown color and displays a tobacco aroma. The essence has a weight of about 1.3 g and a nicotine content of about 30.8 percent.

What is claimed is:

1. A process for providing a concentrated tobacco extract, the process consisting essentially of the steps of:

(a) extracting components from tobacco material with a first solvent having an aqueous character, and then (b) providing the tobacco components extracted by the first solvent in a low solvent form, (c) providing a second solvent different from the first solvent, (d) extracting a portion of the components from the tobacco components resulting from step (b) with the second solvent, and then (e) isolating tobacco components extracted by the second solvent from the second solvent.

2. The process of claim 1 whereby the first solvent is water.

3. The process of claim 1 whereby the first solvent is a mixture of water and an alcohol.

4. The process of claim 1 whereby the components extracted in step (a) are subjected to a spray drying operation.

5. The process of claim 1 whereby the first solvent is water, the components extracted in step (a) are subjected to a spray drying operation, and the resulting extracted components thereby provided have a moisture content of less than 10 weight percent.

6. The process of claim 4 or 5 whereby the second solvent includes an alcohol.

7. The process of claim 4 or 5 whereby the tobacco material is in cut filler or strip form, the process further involving the step of applying isolated extracted components resulting from step (e) to spent tobacco material resulting from step (a).

8. The process of claim 1 whereby the second solvent includes an alcohol.

9. The process of claim 1, 2, 3, 4, 5 or 8 whereby extracted components of step (d) are isolated from the second solvent by an evaporation operation of the second solvent.

10. The process of claim 1, 2, 3, 4 or 5 whereby the second solvent is a co-solvent mixture.

11. The process of claim 1, 2, 3, 4 or 5 whereby the second solvent includes methanol.

12. The process of claim 1, 2, 3, 4 or 5 whereby the second solvent includes ethanol.

13. The process of claim 1, 2, 3, 4 or 5 further involving the step of collecting and isolating residual components not extracted in step (d).

14. The process of claim 1 whereby the tobacco material is in cut filler or strip form, the process further involving the step of applying isolated extracted components resulting from step (e) to spent tobacco material resulting from step (a).

15. The process of claim 14 whereby the spent tobacco material is dried to a moisture level of less than about 15 weight percent prior to the time that the isolated extracted components are applied thereto.

16. The process of claim 1 whereby the second solvent includes methanol and essentially all of the extracted components are isolated from the second solvent in step (e).

17. The process of claim 1 whereby the second solvent includes ethanol and essentially all of the extracted components are isolated from the second solvent in step (e).

18. The process of claim 1, 2, 4, 7, 14 or 15 whereby the first and second solvents are miscible with one another.

19. The process of claim 1, whereby the extraction step performed in step (d) is performed using an organic solvent in liquid form.

20. A process for providing a concentrated tobacco extract, the process consisting essentially of the steps of:

(a) extracting components from tobacco material with a first solvent having an aqueous character, and then (b) subjecting the first solvent and tobacco components extracted thereby to a solvent removal process sufficient at least to provide an extracted tobacco material in a predominantly solid paste form, (c) providing a second solvent different from the first solvent, (d) extracting components from the tobacco material resulting from step (b) with the second solvent, and (e) isolating components extracted by the second solvent from the second solvent.

21. The process of claim 20 whereby the first solvent is water.

22. The process of claim 20 whereby the first solvent is a mixture of water and an alcohol.

23. The process of claim 20 whereby the second solvent includes an alcohol.

24. The process of claim 20, 21, 22 or 23 whereby extracted components of step (d) are isolated from the second solvent by an evaporation operation by the second solvent.

25. The process of claim 20, 21, 22 or 23 whereby the second solvent is a co-solvent mixture.

26. The process of claim 20, 21, 22 or 23 whereby the second solvent includes methanol.

27. The process of claim 20, 21, 22 or 23 whereby the second solvent includes ethanol.

28. The process of claim 20 whereby the second solvent includes methanol and essentially all of the extracted components are isolated from the second solvent in step (e).

29. The process of claim 20 whereby the second solvent includes ethanol and essentially all of the extracted components are isolated from the second solvent in step (e).

30. The process of claim 20 whereby the first and second solvents are miscible with one another.

31. The process of claim 20, whereby the extraction step performed in step (d) is performed using an organic solvent in liquid form.

32. A process for providing a concentrated tobacco extract, the process consisting essentially of:

(a) extracting components from tobacco material with a first solvent having an aqueous character, and then (b) subjecting the first solvent and tobacco components extracted thereby to a solvent removal process, thereby providing an extracted tobacco material having a first solvent content of less than about 25 weight percent, (c) providing a second solvent different from the first solvent, (d) extracting components from the tobacco material resulting from step (b) with the second solvent, and (e) isolating components extracted by the second solvent from the second solvent.

33. The process of claim 32 whereby the first solvent and tobacco components extracted thereby are subjected to a solvent removal process sufficient to provide an extracted tobacco material having a first solvent content of less than about 20 weight percent.

34. The process of claim 32 whereby the first solvent and tobacco components extracted thereby are subjected to a solvent removal process sufficient to provide an extracted tobacco material having a first solvent content of less than about 15 weight percent.

35. The process of claim 32, 33 or 34 whereby the first solvent is water.

36. The process of claim 35 whereby extracted components of step (d) are isolated from the second solvent by an evaporation operation of the second solvent.

37. The process of claim 35 whereby the second solvent is a co-solvent mixture.

38. The process of claim 35 whereby the second solvent includes methanol.

39. The process of claim 35 whereby the second solvent includes ethanol.

40. The process of claim 32 whereby the first and second solvents are miscible with one another.

41. The process of claim 32, 33 or 34 whereby the first solvent is a mixture of water and an alcohol.

42. The process of claim 32, 33 or 34 whereby the second solvent includes an alcohol.

43. The process of claim 32, 33 or 34 whereby extracted components of step (d) are isolated from the second solvent by an evaporation operation of the second solvent.

44. The process of claim 32, 33 or 34 whereby the second solvent is a co-solvent mixture.

45. The process of claim 32, 33 or 34 whereby the second solvent includes methanol.

46. The process of claim 32, 33 or 34 whereby the second solvent includes ethanol.

47. The process of claim 32, 33 or 34 whereby the first and second solvents are miscible with one another.

48. The process of claim 32, whereby the extraction step performed in step (d) is performed using an organic solvent in liquid form.

49. A process for providing a concentrated tobacco extract, the process comprising:

(a) extracting components from tobacco material with a first solvent having an aqueous character, (b) subjecting the first solvent and tobacco components extracted thereby to a spray drying process, thereby providing a spray dried tobacco material, (c) providing a second solvent different from the first solvent, (d) extracting a portion of the tobacco components from the spray dried tobacco material with the second solvent, and then (e) isolating tobacco components extracted by the second solvent from the second solvent.

50. The process of claim 49 whereby the second solvent includes an alcohol.

51. The process of claim 49 whereby the second solvent includes methanol.

52. The process of claim 49 whereby the second solvent includes ethanol.

53. The process of claim 49 whereby the first solvent is water.

54. The process of claim 49 whereby the second solvent is a co-solvent mixture.

55. The process of claim 49 whereby the first and second solvents are miscible with one another.

56. The process of claim 49 whereby the spray drying process provides extracted tobacco components in a low solvent form.

57. The process of claim 49, whereby the extraction step performed in step (d) is performed using an organic solvent in liquid form.

58. A process for providing a concentrated tobacco extract, the process comprising:

(a) extracting components from tobacco material with a first solvent having an aqueous character, (b) subjecting the first solvent and tobacco components extracted thereby to a freeze drying process, thereby providing a freeze dried tobacco material, (c) providing a second solvent different from the first solvent, (d) extracting a portion of the tobacco components from the freeze dried tobacco material with the second solvent, and then (e) isolating tobacco components extracted by the second solvent from the second solvent.

59. The process of claim 58 whereby the second solvent includes an alcohol.

60. The process of claim 58 whereby the second solvent includes methanol.

61. The process of claim 58 whereby the second solvent includes ethanol.

62. The process of claim 58 whereby the first solvent is water.

63. The process of claim 58 whereby the second solvent is a co-solvent mixture.

64. The process of claim 58 whereby the first and second solvents are miscible with one another.

65. The process of claim 58 wherein the freeze drying process provides extracted tobacco components in a low solvent form.

66. The process of claim 58, whereby the extraction step performed in step (d) is performed using an organic solvent in liquid form.

67. A process for providing a tobacco extract, the process consisting essentially of the steps of:

(a) extracting components from tobacco material with a first solvent having an aqueous character, and then (b) subjecting the first solvent and tobacco components extracted thereby to a solvent removal process, thereby providing an extracted tobacco material having a first solvent content of less than about 25 weight percent, (c) providing a second solvent different from the first solvent, (d) extracting a portion of the components from the tobacco material resulting from step (b) with the second solvent, and then (e) separating the second solvent and tobacco components extracted thereby from that portion of the tobacco material which remains unextracted by the second solvent.

68. The process of claim 67 whereby the first solvent and tobacco components extracted thereby are subjected to a solvent removal process sufficient to provide an extracted tobacco material having a first solvent content of less than about 20 weight percent.

69. The process of claim 67 whereby the first solvent and tobacco components extracted thereby are subjected to a solvent removal process sufficient to provide an extracted tobacco material having a first solvent content of less than about 15 weight percent.

70. The process of claim 54, 55 or 56 further involving the step of subjecting the second solvent and tobacco components extracted thereby to conditions sufficient to separate a majority of the second solvent therefrom.

71. The process of claim 70 whereby the second solvent includes methanol.

72. The process of claim 70 whereby the second solvent includes methanol.

73. The process of claim 67, 68 or 69 whereby the first solvent is water.

74. The process of claim 70 whereby the first solvent is water.

75. The process of claim 67, 68 or 69 whereby the second solvent is an alcohol.

76. The process of claim 70 whereby the second solvent is an alcohol.

77. The process of claim 67, 68 or 69 whereby the second solvent includes methanol.

78. The process of claim 67, 68 or 69 whereby the second solvent includes ethanol.

79. The process of claim 67, whereby the extraction step performed in step (d) is performed using an organic solvent in liquid form.

80. A process for providing a tobacco extract, the process comprising:

(a) extracting components from tobacco material with a first solvent having an aqueous character, (b) subjecting the first solvent and tobacco components extracted thereby to a spray drying process, thereby providing a spray dried tobacco material, (c) providing a second solvent different from the first solvent, (d) extracting a portion of the tobacco components from the spray dried tobacco material with the second solvent, and then (e) separating the second solvent and tobacco components extracted thereby from that portion of spray dried tobacco material which remains unextracted by the second solvent.

81. The process of claim 80 whereby the second solvent includes an alcohol.

82. The process of claim 80 whereby the second solvent includes methanol.

83. The process of claim 80 whereby the second solvent includes ethanol.

84. The process of claim 80, 81, 82 or 83 further comprising subjecting the second solvent and tobacco components extracted thereby to conditions sufficient to separate a majority of the second solvent therefrom.

85. The process of claim 80 whereby the first solvent is water.

86. The process of claim 80 whereby the second solvent is a co-solvent mixture.

87. The process of claim 80 whereby the first and second solvents are miscible with one another.

88. The process of claim 80 whereby the spray drying process provides extracted tobacco components in a low solvent form.

89. The process of claim 88 further comprising subjecting the second solvent and tobacco components extracted thereby to conditions sufficient to separate a majority of the second solvent therefrom.

90. The process of claim 80, whereby the extraction step performed in step (d) is performed using an organic solvent in liquid form.

91. A process for providing a tobacco extract, the process comprising:

(a) extracting components from tobacco material with a first solvent having an aqueous character, (b) subjecting the first solvent and tobacco components extracted thereby to a freeze drying process, thereby providing a freeze dried tobacco material, (c) providing a second solvent different from the first solvent, (d) extracting a portion of the tobacco components from the freeze dried tobacco material with the second solvent, and then (e) separating the second solvent and tobacco components extracted thereby from that portion of the freeze dried tobacco material which remains unextracted by the second solvent.

92. The process of claim 91 whereby the second solvent includes an alcohol.

93. The process of claim 91 whereby the second solvent includes methanol.

94. The process of claim 91 whereby the second solvent includes ethanol.

95. Process of claim 91, 92, 93 or 94 further comprising subjecting the second solvent and tobacco components extracted thereby to conditions sufficient to separate a majority of the second solvent therefrom.

96. The process of claim 91 whereby the first solvent is water.

97. The process of claim 91 whereby the second solvent is a co-solvent mixture.

98. The process of claim 91 whereby the first and second solvents are miscible with one another.

99. The process of claim 91 whereby the freeze drying process provides extracted tobacco components in a low solvent form.

100. The process of claim 99 further comprising subjecting the second solvent and tobacco components extracted thereby to conditions sufficient to separate a majority of the second solvent therefrom.

101. The process of claim 91, whereby the extraction step performed in step (d) is performed using an organic solvent in liquid form.

102. A process for providing a tobacco extract, the process consisting essentially of the steps of:

(a) extracting components from tobacco material with a first solvent having an aqueous character, and then (b) providing the tobacco components extracted by the first solvent in a low solvent form, (c) providing a second solvent different from the first solvent, (d) extracting a portion of the tobacco components from the components resulting from step (b) with the second solvent, and then (e) separating the second solvent and tobacco components extracted thereby from that portion of the tobacco components which remains unextracted by the second solvent.

103. The process of claim 102 further involving the step of subjecting the second solvent and tobacco components extracted thereby to conditions sufficient to separate a majority of the second solvent therefrom.

104. The process of claim 102 or 103 whereby the first solvent is water.

105. The process of claim 104 whereby the second solvent includes methanol.

106. The process of claim 104 whereby the second solvent includes ethanol.

107. The process of claim 104 further involving the step of subjecting the second solvent and tobacco components extracted thereby to conditions sufficient to separate a majority of the second solvent therefrom.

108. The process of claim 102 or 103 whereby the second solvent includes an alcohol.

109. The process of claim 102 or 103 whereby the second solvent includes methanol.

110. The process of claim 102 or 103 whereby the second solvent includes ethanol.

111. The process of claim 102 or 103 whereby the first and second solvents are miscible with one another.

112. The process of claim 102, whereby the extraction step performed in step (d) is performed using an organic solvent in liquid form.

113. A process for providing a tobacco extract, the process consisting essentially of:

(a) extracting components from tobacco material with a first solvent having an aqueous character, (b) subjecting the first solvent and tobacco components extracted thereby to a solvent removal process sufficient at least to provide an extracted tobacco material in a predominantly solid paste form, and then (c) providing a second solvent different from the first solvent, (d) extracting a portion of the components from the tobacco material resulting from step (b) with the second solvent, and then (e) separating the second solvent and tobacco components extracted thereby from that portion of the tobacco material which remains unextracted by the second solvent.

114. The process of claim 113 or 107 whereby the first solvent is water.

115. The process of claim 114 whereby the second adjacent includes an alcohol.

116. The process of claim 114 whereby the second solvent includes methanol.

117. The process of claim 114 whereby the second solvent includes ethanol.

118. The process of claim 114 whereby the first and second solvents are miscible with one another.

119. The process of claim 113 or 107 whereby the second solvent includes an alcohol.

120. The process of claim 113 or 107 whereby the second solvent includes methanol.

121. The process of claim 113 or 107 whereby the second solvent includes ethanol.

122. The process of claim 113 or 107 whereby the first and second solvents are miscible with one another.

123. The process of claim 113, whereby the extraction step performed in step (d) is performed using an organic solvent in liquid form.

* * * * *